US005553790A

United States Patent [19]

Findler et al.

[11] Patent Number: 5,553,790

[45] Date of Patent: Sep. 10, 1996

[54] ORIFICE ELEMENT AND VALVE WITH ORIFICE ELEMENT

[75] Inventors: Guenther Findler, Stuttgart; Juergen Buchholz, Lauffen; Udo Jauernig, Reutlingen, all of Germany

[73] Assignee: Robert Bosch GmbH, Stuttgart, Germany

[21] Appl. No.: 308,720

[22] Filed: Sep. 19, 1994

[30] Foreign Application Priority Data

Sep. 20, 1993 [DE] Germany ..... 43 31 851.7

[51] Int. Cl.[6] ..... B05B 1/30

[52] U.S. Cl. ..... 239/585.1; 239/596

[58] Field of Search ..... 239/596, 533.1, 239/585.1, 585.4, 533.12

[56] References Cited

U.S. PATENT DOCUMENTS

| | | | |
|---|---|---|---|
| 4,828,184 | 5/1989 | Gardner et al. | 239/590.3 |
| 4,907,748 | 3/1990 | Gardner et al. | 239/584 |
| 4,934,653 | 6/1990 | Grieb et al. | 239/552 |
| 5,016,819 | 5/1991 | Wood | 239/585.1 |
| 5,035,358 | 7/1991 | Katsuno et al. | 239/403 |
| 5,244,154 | 9/1993 | Buchholz et al. | 239/585.4 |
| 5,261,639 | 11/1993 | Bantien et al. | 239/585.1 |
| 5,323,966 | 6/1994 | Buchholz et al. | 239/533.12 |
| 5,421,952 | 6/1995 | Buchholz et al. | 216/33 |
| 5,423,489 | 9/1995 | Wood | 239/585.1 |
| 5,449,114 | 9/1995 | Wells et al. | 239/596 |

FOREIGN PATENT DOCUMENTS

| | | | |
|---|---|---|---|
| 4112150A1 | 3/1992 | Germany | B05B 1/00 |
| 18299 | 9/1993 | WIPO | 239/585.1 |

*Primary Examiner*—Andres Kashnikow
*Assistant Examiner*—Lisa Douglas
*Attorney, Agent, or Firm*—Kenyon & Kenyon

[57] ABSTRACT

Orifice elements for use in valves for injecting fuel or a fuel-gas mixture. The orifice elements include two silicon plates, joined to one another. An upper plate has one or more injection orifices. The lower plate has a through hole introduced in it, through which a fuel jet can emerge. The lower plate follows in the downstream direction and includes a jet splitter. The jet splitter divides the through hole into at least two passthrough openings so that a dual-jet characteristic is produced or maintained for the valve. At least two conduits are formed between the upper plate and the lower plate. Gas is provided via the conduits and is mixed with the fuel discharged through the injection orifice. The injection orifice and the valve are particularly suited for injection systems of mixture-compressing internal-combustion engines having externally supplied ignition.

19 Claims, 9 Drawing Sheets

ORIFICE ELEMENT AND VALVE WITH ORIFICE ELEMENT

FIELD OF THE INVENTION

The present invention is related to an orifice element (or a valve with an orifice element) for injecting a medium. In particular, the present invention is related to an orifice element having an upper plate which has at least one injection orifice, and at least one lower plate which has at least one pass through opening and which is located downstream from the upper plate. In particular, the present invention is related to a fuel injection valve for supplying an internal combustion engine with an air-fuel mixture. The fuel injection valve has a valve-closure part which interacts with a valve seat surface, and a thin, plate shaped, orifice element arranged downstream from the valve seat surface.

BACKGROUND INFORMATION

An injection valve for injecting an air-fuel mixture, in which an orifice element consisting of a silicon injection plate is used, is described in German Published Patent Application No. 41 12 150. The silicon injection plate is manufactured by bonding an upper silicon plate with a lower silicon plate. The upper silicon plate has injection holes. The lower silicon plate has at least one through hole. In addition, recesses are introduced into the silicon plates to form conduits connecting the through hole to an outer edge of the silicon injection plate. Air, for instance, is blown in or suctioned in through these conduits thereby guaranteeing an improved atomization of the liquid flowing through the injection holes. The silicon plates are fabricated by anisotropic etching.

U.S. Pat. No. 4,907,748 likewise describes an injection valve that employs an orifice element (silicon nozzle plate) consisting of two silicon plates coupled to one another. The spray-discharge openings of the upper plate and the passthrough opening of the lower plate are offset from one another. The plates are used for preparing (or metering) fuel and not for dosing (i.e., quantitatively regulating) a gas surrounding the fuel.

U.S. Pat. No. 4,828,184 describes a nozzle which comprises two silicon plates. The first silicon plate has at least one opening formed therethrough, and the second silicon plate has precisely one opening formed therethrough. The openings of the first and second silicon plates are offset from one another. Regions of reduced thickness are formed between the plates thereby forming a shear gap between the openings of the first plate and the opening of the second plate. In each case, the shear gap is parallel to the end faces of the plates.

All of the above-mentioned injection valves produce a more or less compact single jet of fuel or of another medium being discharged. Unfortunately, the above-mentioned injection valves are not well suited for producing a dual-jet characteristic for the fuel, which is desired, for instance, during the spray-discharging on to two intake valves of an internal combustion engine. Thus, there exists a need for an injection valve which simply and cost-effectively produces a dual-jet characteristic for a medium to be sprayed in a very narrow space.

SUMMARY OF THE INVENTION

The present invention fulfills the above-mentioned need by providing an orifice element having an upper plate and at least one lower plate. The upper plate has at least one injection orifice. The at least one lower plate has at least two passthrough openings and a jet splitter. The jet splitter separates the at least two pass through openings on the lower plate. The at least one injection orifice of the upper plate at least partially overlaps the jet splitter and the pass through openings of the lower plate.

The orifice element of the present invention has the advantage of simply and cost-effectively producing (or maintaining) a dual-jet characteristic for a medium to be spray-discharged in a very narrow space. Moreover, the dual-jet characteristic is fully realized even when a second medium is used to surround the first medium to improve the homogeneity and the preparation of the first medium.

An alternative embodiment of the valve according to the present invention further provides a valve closure part in addition to a thin, plate shaped orifice. The valve closure part interacts with a valve seat surface. The thin, plate shaped, orifice element is arranged downstream of the valve-seat surface. The upper plate faces the valve seat surface. With this arrangement, a dual-jet characteristic of fuel, for instance, is realized simply and cost-effectively with very small tolerances. Moreover, this dual-jet characteristic has an especially precise effect because of the very high manufacturing accuracy.

In a preferred embodiment of the present invention, the plate of the orifice element is made of monocrystalline silicon and the openings and conduits in the plate are formed by anisotropic etching. Thus, the plates can be manufactured simply and demonstrate an unusually high-level of manufacturing precision. This arrangement permits an especially precise metering of the fuel (or of the gas) directed as a second medium at the fuel.

In a preferred embodiment of the present invention, the peripheral shape of the superposed plates have identical dimensions and the superimposed plates are bonded together.

Simultaneously etching the plate containing the spray-jet splitter from two sides is especially advantageous since this reduces the number of processing steps required to manufacture structures in silicon plates. In addition to reducing costs, the above method advantageously permits several different structures to be manufactured by varying the etching time. First, etching masks are arranged on the top side and bottom side of the plate to be etched. Etching solution then attacks the plate for as long as is required to etch half the thickness of the plate. If the etching operation is halted immediately upon reaching half the thickness of the plate, passthrough openings are obtained. The smallest cross-section of the passthrough openings formed by the etching is at about half the thickness of the plate. Thus, a jet splitter with a rhombic or hexagonal cross-section results.

Continuing the etching operation beyond the time necessary to etch half the thickness of the plate results in passthrough openings and jet splitters being formed with flat boundary surfaces. Thus, a jet splitter with a square cross-section results.

Etching advantageously offers simple possibilities for altering the geometry of the passthrough openings, which influences different properties of the orifice element (or of the valve). For example, the size of the jet splitter determines the resulting jet angle of the medium to be sprayed. By varying the widths of the conduits for supplying the second medium, the geometry of the media jets can be altered to form flat jets, for example.

Producing passthrough openings and, thus, the jet splitter, and conduits for supplying a gas in one single etching operation is especially advantageous. This specific embodiment is very simple and, thus, is especially cost-effective. In this embodiment, the conduits introduced run parallel to the jet splitter. The passthrough openings are produced by two-sided etching, while the conduits are only formed in the same etching operation by one-sided etching. The conduits are co-linear and each open through into a passthrough opening. The conduits are only interrupted by the passthrough opening in the plate.

DETAILED DESCRIPTION

Figure 1:
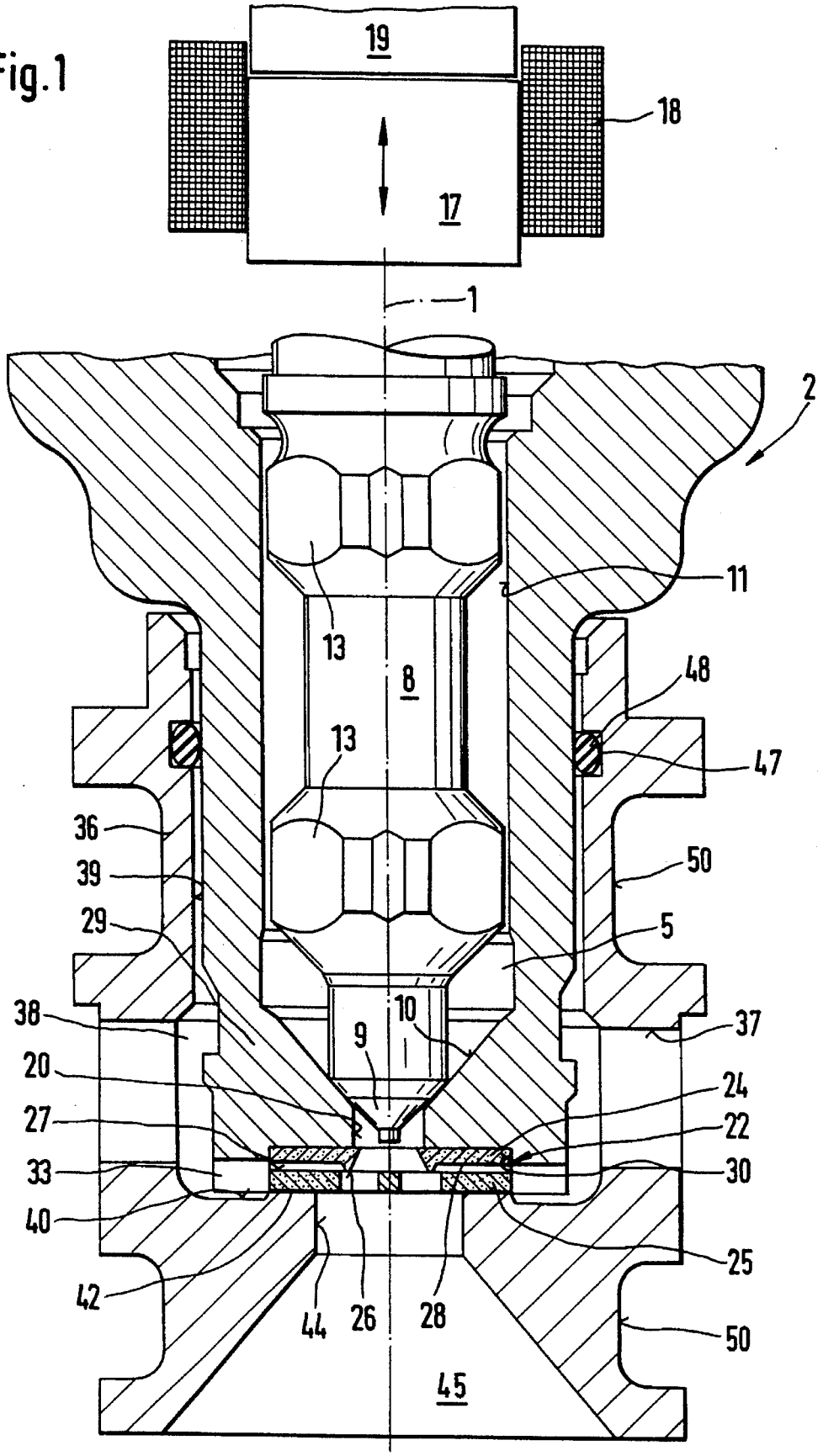
FIG. 1 is a partial, cross-sectional side view of a first exemplary embodiment of an injection valve, designed in accordance with the present invention.

FIG. 1 partially depicts a first embodiment of a fuel-injection valve that can be used, for example, with injection systems of mixture-compressing internal-combustion engines having externally supplied ignition. A valve nozzle member 2 made of, for instance, ferromagnetic material has a conically tapered flow conduit 5 arranged concentrically to a longitudinal valve axis 1. A valve needle 8 is arranged in the flow conduit 5. The downstream end of the valve needle 8 is designed, for example, as a valve closure part 9 conically tapered in the downstream direction. The valve closure part 9 of the valve needle 8 interacts with a valve seat surface 10 of the flow conduit 5. The valve seat surface 10 is conically tapered, for instance, in the direction of flow. A guide section 11 of the flow conduit 5, formed upstream from the valve seat surface 10, guides axial movements of the valve needle 8. The valve needle 8 projects, with guide collars 13, with a small radial clearance through the guide section 11 of the flow conduit 5.

The axial movement of the valve needle 8, and thus, the opening and closing of the valve, takes place in a generally known way, for instance, electromagnetically. As indicated in FIG. 1, the valve needle 8 is connected at its upstream end (i.e., the end facing away from the valve seat surface 10) to an armature 17, which interacts with a solenoid coil 18 and a core 19 of the fuel-injection valve.

The flow conduit 5 continues, for example in the downstream direction (i.e., in the direction facing away from the solenoid coil 18) following the conical valve seat surface 10, in a cylindrical flow-through section 20. A thin orifice element 22 is arranged in the downstream direction directly following the flow-through section 20. The thin orifice element 22 includes, for instance, a square and thin upper plate 24 facing the valve seat surface 10 and a square and thin lower plate 25. The upper plate 24 fits, at least partially with its lower end face 26 facing away from the flow-through section 20, on an upper end face 27 of the lower plate 25 facing the upper plate 24 and is joined to this upper end face 27. Both the upper plate 24 and the lower plate 25 are made, for example, of monocrystalline silicon. However, it is also possible to make the upper plate 24 and the lower plate 25 from another suited material, for example another monocrystalline semiconductor, such as germanium or a composite semiconductor, such as germanium arsenide or glass.

At least one conduit 28 is formed between the upper plate 24 and the lower plate 25. A gas, which is used to produce a fuel-gas mixture, is brought inward from the periphery of the plates 24, 25, via the at least one conduit 28, toward fuel directed through the plates 24, 25.

A recess 30 is formed at a downstream spray-discharge end 29 of the nozzle member 2. To guarantee a constant position of the thin orifice element 22 relative to the flow-through section 20 of the cylindrically tapered flow conduit 5, the recess 30 surrounds the orifice element 22 and the flow-through section 20 opens through at the recess 30. At least one supply groove 33 is formed, for instance, in the radial direction between the periphery of the spray-discharge end 29 of the nozzle member 2 and the recess 30. The at least one supply groove 33 is in fluid communication with the at least one conduit 28 thereby permitting gas to arrive at the at least one conduit 28 of the orifice element 22.

At its spray-discharge end 29, the nozzle member 2 is at least partially surrounded, both in the radial as well as in the axial direction, by a supply bushing 36, for example. In the axial direction, in the vicinity of the spray-discharge end 29, the supply bushing 36 has, for instance, transverse openings 37, which extend in the radial direction from the periphery of the supply bushing 36, inwardly, to an annular supply space 38. The annular supply space 38 is configured between the periphery of the spray-discharge end 29 and a stepped longitudinal opening 39 of the supply bushing 36.

A base 40 of the supply bushing 36 facing the spray-discharge end 29 of the nozzle member 2 has, for instance, a bearing surface 42. The bearing surface 42 is perpendicular to, and disposed concentrically around, the longitudinal valve axis 1. The bearing surface 42 faces the spray discharge end 29 of the nozzle member 2. The bearing surface 42 includes a side surface facing the longitudinal valve axis 1 in the radial direction. With the bearing surface 42, the supply bushing 36 tightly holds the orifice element 22 against the valve nozzle 2, thus reliably fixing the axial position of the orifice element 22 in the recess 30 of the nozzle member 2 and ensuring that the gas flows exclusively via the at least one conduit 28 toward the spray-discharged fuel. In the direction of flow, following the orifice element 22 is, for instance, a cylindrical opening 44, which extends downstream from the base 40 of the supply bushing 36, concentrically to the longitudinal valve axis 1. Following the cylindrical opening 44 is a mixture-spray-discharge opening 45 that widens in a funnel shape.

A circumferential groove 47, which accommodates a sealing ring 48, is formed in the longitudinal opening 39 of the supply bushing 36 at its end facing away from the mixture-spray-discharge opening 45. The sealing ring 48 forms a seal between the periphery of the nozzle member 2 and the longitudinal opening 39 of the supply bushing 36.

If the valve, with its supply bushing 36, is assembled in a valve mount, for example in an intake line of the internal combustion engine, sealing off the supply bushing 36, above and below its transverse openings 37, from the inner wall of the valve mount is necessary. For this purpose, grooves 50, in which a sealing ring (not shown) can be arranged in each case, are formed on the periphery of the supply bushing 36.

Figure 2:
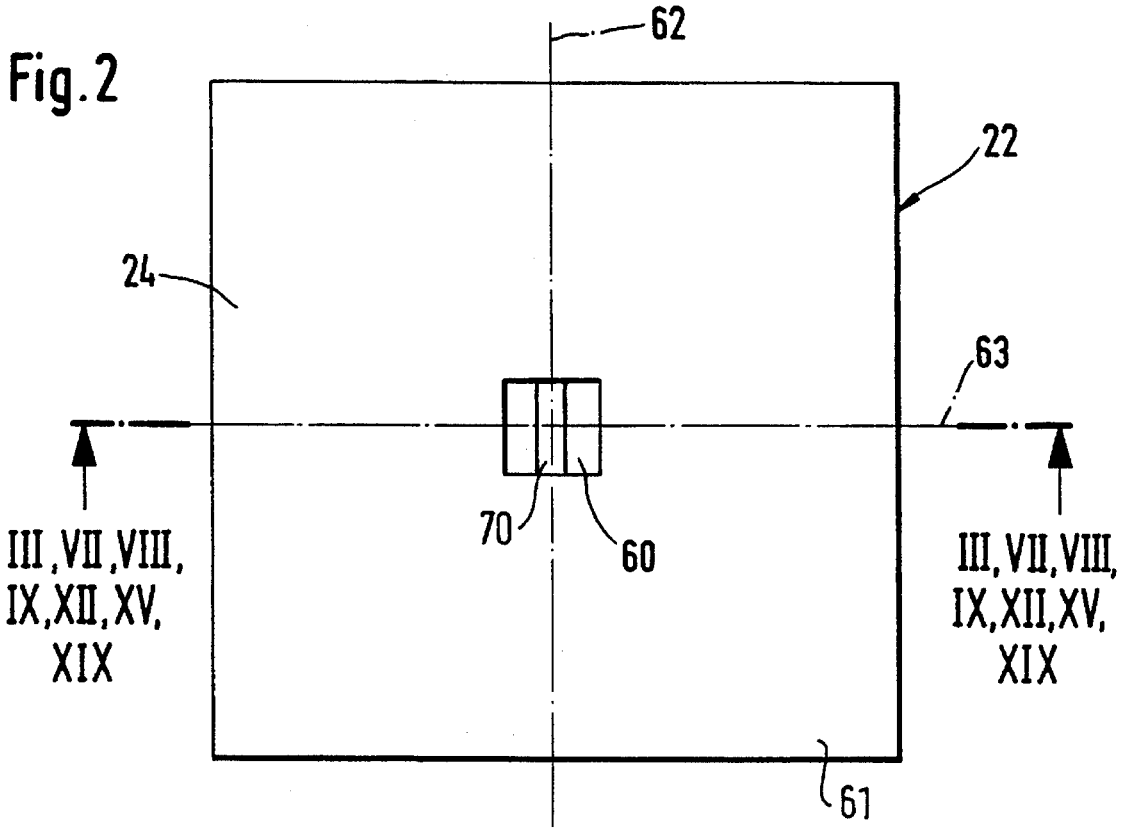
FIG. 2 is a top view of an upper plate of an orifice element in accordance with the first exemplary embodiment of the present invention. The jet splitter of a lower plate is also shown.
Figure 3:
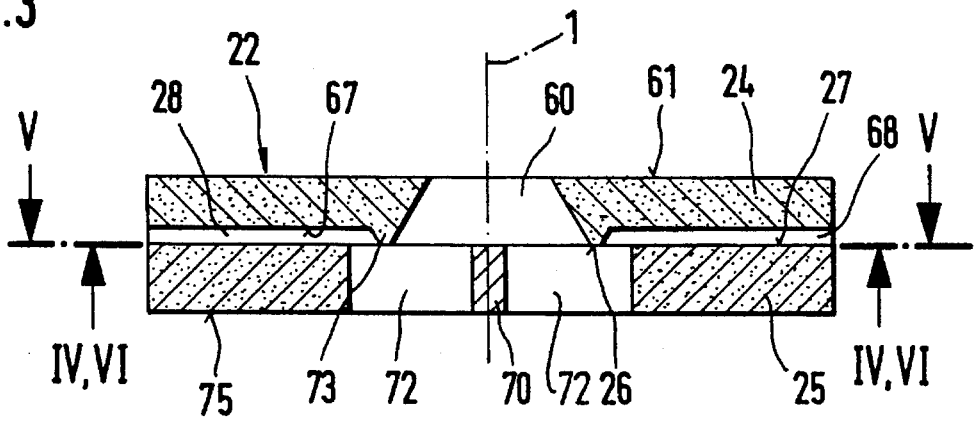
FIG. 3 illustrates a section along the line III—III in FIG. 2.

FIG. 2 is a top view of an upper plate 24 of the orifice element 22 in accordance with the first exemplary embodiment of the present invention shown in FIG. 1. FIG. 3 shows the first exemplary embodiment of the orifice element 22, which corresponds to a section along the line III—III in FIG. 2. As these Figures illustrate, the upper plate 24 (which is square for example) has a pyramid-stump-shaped injection orifice 60 of trapazoid-shape cross-sections. The injection orifice 60 is arranged symmetrically to the longitudinal valve axis 1 and widens, starting from an upper side 61 of the upper plate 24 toward the lower end face 26 of the upper plate 24. The cylindrical flow-through section 20 of the flow conduit 5 has a cross-section that overlaps the injection orifice 60 and is upstream from the injection orifice 60.

The outer contour of the lower plate 25 likewise has a square design, for example. As far as the assembly of the orifice element 22, it is especially expedient for the upper plate 24 and the lower plate 25 to have identical dimensions with respect to the peripheral shape. It is simple to achieve such identical dimensions for the individual plates 24, 25, since the wafers containing the plates 24, 25 are adjusted to allow them to be bonded to one another. Thin orifice elements 22 are then dissociated in one sequence of operation by sawing the two plates 24, 25 out of the wafers.

The orifice element 22 has a first axis of symmetry 62 and a second axis of symmetry 63 perpendicular to the first. Each of the first and second axes of symmetry 62, 63 halve the outer side surfaces of the upper and the lower plates 24, 25 and define a plane that is perpendicular to the longitudinal valve axis 1. The longitudinal valve axis 1 intersects this plane at the intersection of the first and second axes of symmetry 62, 63.

Figure 4:
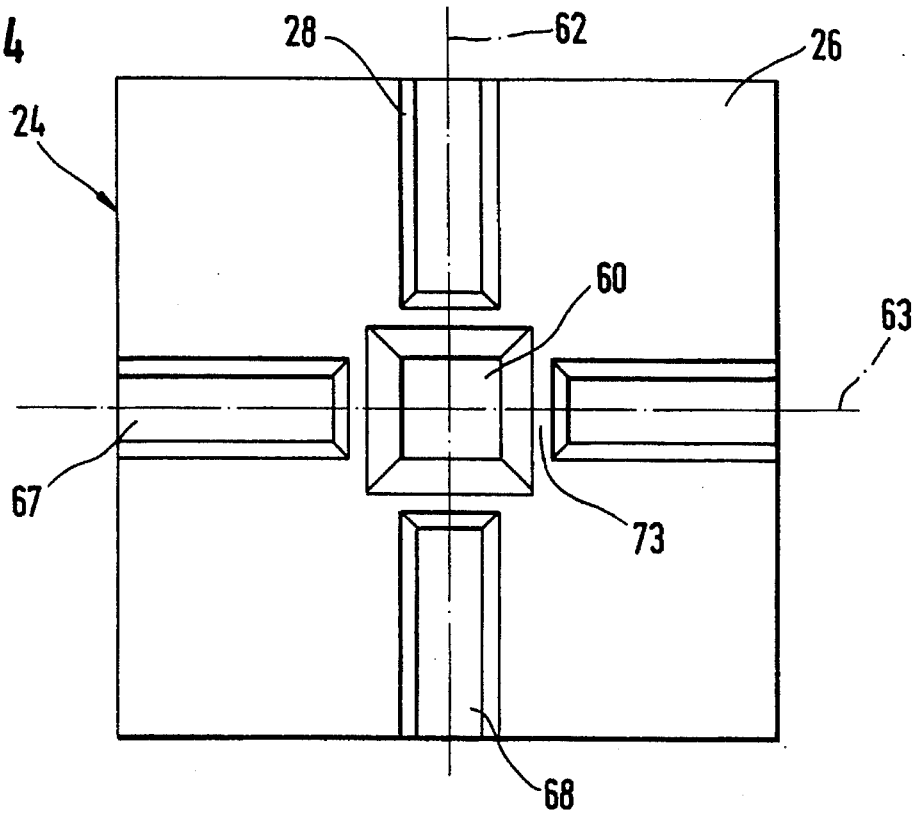
FIG. 4 is a plan view of an upper plate corresponding to the sections along the lines IV—IV in FIGS. 3 and 7.

One conduit 28, in the form of a trench with a rectangular trench bottom 67, is formed, in each case, starting from an outer edge surface of the upper plate 24, on its bottom end face 26, in mid-symmetry to each of the axes of symmetry 62 and 63 (see e.g., FIG. 4). The trench bottoms 67 produced, for example, by the four conduits 28, abut on the lower end face 26 of the upper plate 24 facing away from the upper end face 27 of the lower plate 25. The conduits 28 widen in a trapezoidal shape, in the direction leading from the trench bottoms 67 toward the lower end face 26 of the upper plate 24. Each of the conduits 28 form an inflow space 68, together with the upper end face 27 of the lower plate 25.

A jet splitter 70, in the form of a web (or a blade), is provided in the lower plate 25 and has an upstream to downstream thickness equal to the upstream to downstream thickness of the lower plate 25. The jet splitter 70 ensures that fuel flowing out of the flow-through section 20 of the nozzle member 2 and downstream through the injection orifice 60 of the upper plate 24 of the orifice element 22 is split, for example, into two passthrough openings 72.

The jet splitter 70, running along the axis of symmetry 62, separates a passthrough opening 72 situated in FIG. 2 to the right of the axis of symmetry 62 from a passthrough opening 72 situated to the left of the axis of symmetry 62. The passthrough openings 72 have either a rectangular, or even a square cross-sectional shape. Forming the jet splitter 70 in the lower plate 25 of the orifice element 22 is especially advantageous for dual-jet valves because the atomization quality of the dual jet valves is clearly improved by the surrounding gas in the individual passthrough openings 72.

In spite of the surrounding gas, a dual-jet characteristic of the valve can be produced and completely maintained by the jet splitter 70. The conduits 28 having trench bottoms 67 which run in parallel with the axes of symmetry 62 and/or 63, are formed in the upper plate 24 so as not to allow any direct connection to the injection orifice 60. Rather, the injection orifice 60 is spatially separated from the conduits 28 by means of protrusions 73. The extent of the protrusions 73 in the direction of the longitudinal valve axis 1 is the same as that of the conduits 28. In the vertical direction, the protrusions 73 extend from the trench bottoms 67 of the conduits 28 down to the lower end face 26 of the upper plate 24.

Since the injection orifice 60 is completely overlapped by the outer boundary edges of the passthrough openings 72, and since the conduits 28 are partially overlapped, by the outer boundary edge of the passthrough openings 72 in the lower plate 25, the fuel and the gas, for example air, can flow easily into the passthrough openings 72. Thus, the mixture is first formed in the passthrough openings 72 of the lower plate 25.

Figure 5:
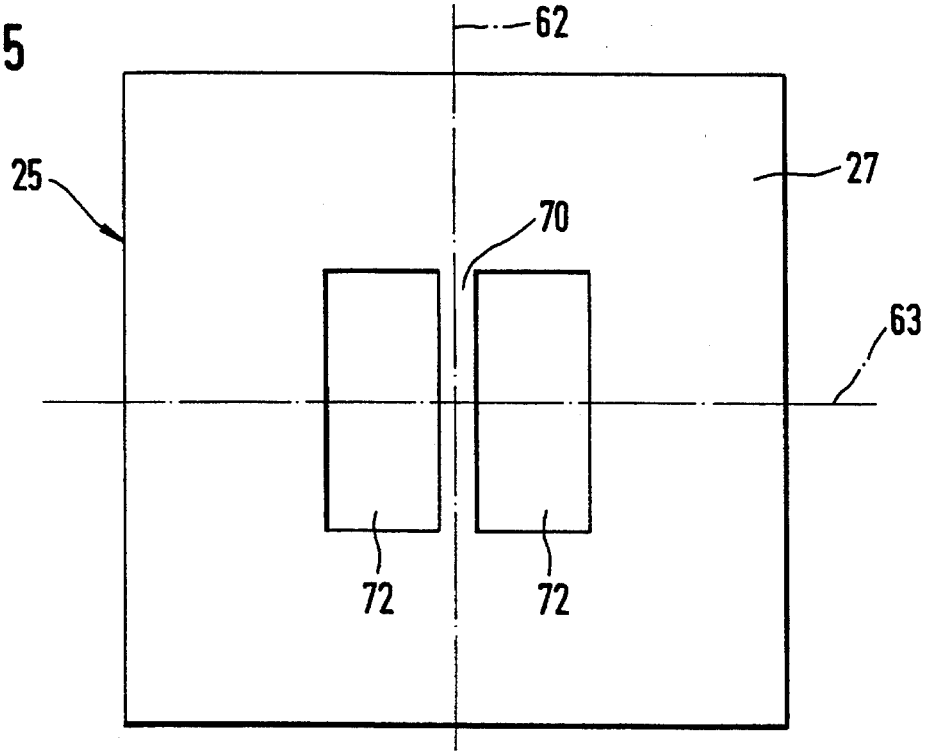
FIG. 5 is a plan view of a lower plate corresponding to the sections along the lines V—V in FIGS. 3, 9, 12, 18 and 19.
Figure 6:
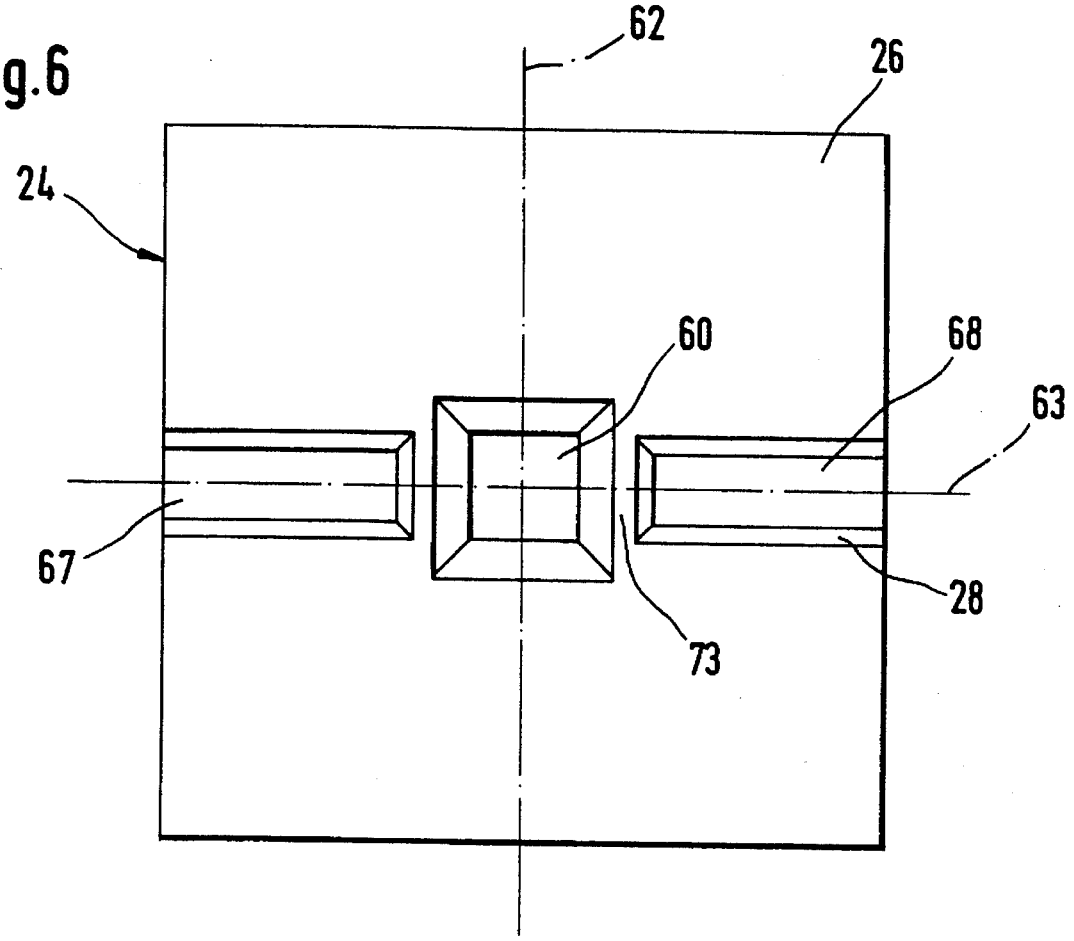
FIG. 6 is a plan view of an upper plate corresponding to the sections along the lines VI—VI in FIGS. 3 and 7 in accordance with a second exemplary embodiment of the present invention.

FIGS. 4, 5 and 6 depict sectional views of a first and a second exemplary embodiment of the present invention. FIGS. 4, 5 and 6 are cross-sections along the lines IV—IV, V—V, and VI—VI, respectively, in FIG. 3. The intersecting plane is the joining surface of the upper plate 24 and the lower plate 25. FIG. 4 illustrates how the four conduits 28 are directed toward the intersection point of the axes of symmetry 62 and 63. The four conduits 28 extend inward beyond the outer boundary edges of the passthrough openings 72 in the lower plate 25 as shown in FIGS. 4 and 5. Thus, the four conduits 28 guarantee that the gas flows into the passthrough openings 72. When the gas flowing in through the two conduits 28 along the axis of symmetry 62 encounters the jet splitter 70, it is split up into the two passthrough openings 72.

FIG. 6 illustrates a second exemplary embodiment of the present invention, in which only two conduits 28 are formed along the axis of symmetry 63 and no conduits 28 are formed along the axis of symmetry 62. Thus, the gas of each conduit 28 flows into an adjacent passthrough opening 72. The extent of the passthrough openings 72 and, thus, of the jet splitter 70 along the axis of symmetry 63 can be substantially smaller, when compared to the first exemplary embodiment, so that, for example, square passthrough openings 72 are formed.

The injection orifice 60 and the conduits 28, as well as the passthrough openings 72 in the upper plates 24 and lower plates 25 consisting of monocrystalline silicon are formed, as is generally known, by anisotropic etching, for example. First the flat surfaces of a thin silicon plate are polished. Next, the flat surfaces are coated with a thin oxide layer. Then, a photo-layer is applied to the flat surfaces. A photomask is placed on the photo-layer and subsequently irradiated. A developer liquid is applied to form a pattern consisting of the locations covered with the photo-layer and exposed oxide on the plate. The exposed oxide spots are etched away in a bath with hydrofluoric acid, and the photo-layer is subsequently removed.

Thus, an oxide pattern on the plate, which serves as a mask for the subsequent etching, is obtained. Alkaline solutions or acids attack the exposed silicon and allow depressions to be formed in the monocrystalline plate. When anisotropic etching means are used, the depressions grow deeper, without substantial widening. The side walls of the depressions are formed in this case by the crystal planes of the silicon plate. As a result, depressions having a trapezoidal cross-section are formed.

Besides the pyramid-stump-shaped injection orifice 60 (having trapezoidal shaped cross-sections) and the trapezoidal shaped cross-section of the conduits 28 formed by anisotropic etching, rectangular cross-sections are also possible, as exhibited, for example, by the passthrough openings 72. This cross-sectional shape can be achieved by, for example, etching the plate simultaneously from two sides. Thus, for example, the lower plate 25 may be etched from the top end face 27 and from a side 75 of the lower plate 25 situated opposite this top end face 27. These etching methods also produce the flat boundary surfaces of the jet splitter 70.

The lower end face 26 of the upper plate 24 and the upper end face 27 of the lower plate 25 are joined together by bonding two wafers containing the plates 24, 25. For this purpose, the lower end face 26 of the upper plate 24 and the upper end face 27 of the lower plate 25 are initially polished, and the surfaces are chemically treated. Thin layers, for example of silicon oxide, can be produced (or deposited) thereby on the top surfaces of the plates 24 and 25. Another surface treatment consists, for example, of immersing the plates 24 and 25 in etching and cleaning solutions. The prepared surfaces of the wafer and, thus, of the upper plate 24 and of the lower plate 25 to be joined together, are brought together at room temperature.

The bonding process is ended, for example, by subjecting the upper plate 24 to a temperature treatment and the lower plate 25 to a nitrogen atmosphere. In this case, both the silicon direct bonding (silicon fusion bonding) as well as an anodic bonding in the case of glass-silicon compounds, can be used with the application of an electric field. After the wafers are bonded, they are cut into a plurality of plates 24, 25.

As shown in FIG. 1, the gas used to form the fuel-gas mixture flows through the transverse openings 37 to the annular supply space 38. The supply space 38 is formed between the periphery of the nozzle member 2 and the longitudinal opening 39 of the supply bushing 36. From there, the gas flows, for example, through the four inflow spaces 68 defined by the conduits 28. From there, the gas flows to the two passthrough openings 72 of the orifice element 22, which are separated from one another by the jet splitter 70. The fuel from the injection orifice 60 is also discharged into the two passthrough openings 72 of the orifice element.

The conduits 28 have a narrow cross-section. This narrow cross-section is useful for metering-in the gas. In addition, the narrow cross-section causes the gas to be accelerated, so that the gas encounters the spray-discharged fuel at a high speed and surrounds this fuel while forming very fine droplets. Thus, a substantially homogeneous fuel-gas mixture is produced. The fuel-gas mixture is discharged through the mixture-spray-discharge opening 45, for example, into the intake line of the internal combustion engine. The gas is, for instance, air that is branched off through a by-pass upstream from a throttle valve in the induction manifold of the internal combustion engine. However, recirculated exhaust gas from the internal combustion engine can also be used to reduce pollutant emission. A gas delivered by an auxiliary fan can also be used.

Figure 7:
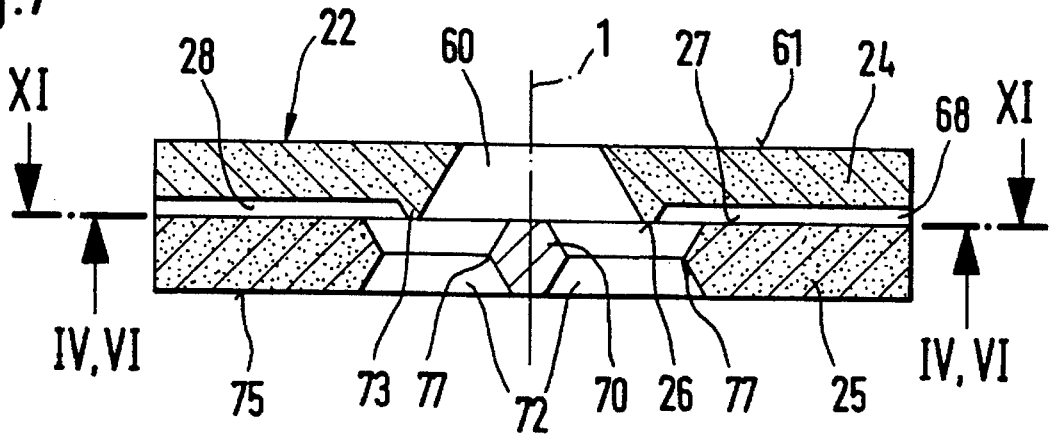
FIG. 7 illustrates a section along the line VII—VII in FIG. 2 in accordance with a third exemplary embodiment of the present invention.
Figure 8:
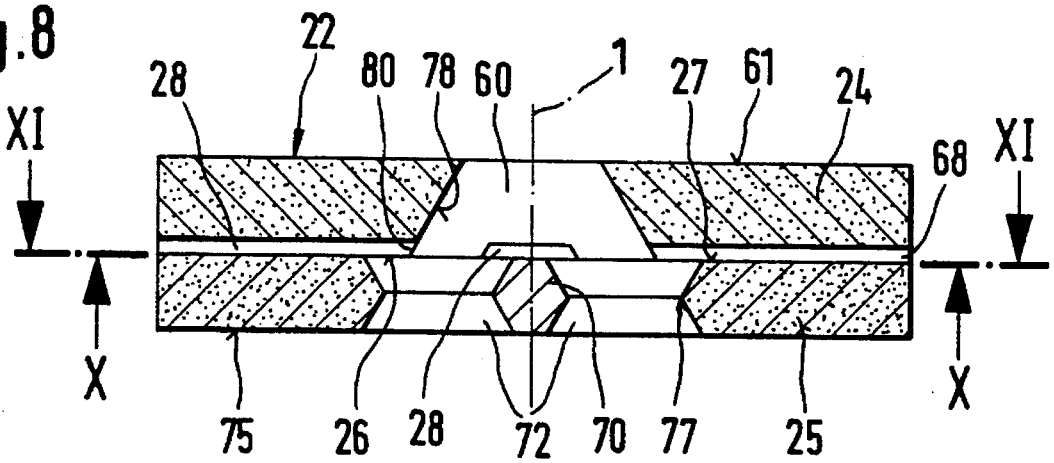
FIG. 8 illustrates a section along the line VIII—VIII in FIG. 2 in accordance with a fourth exemplary embodiment of the present invention.
Figure 9:
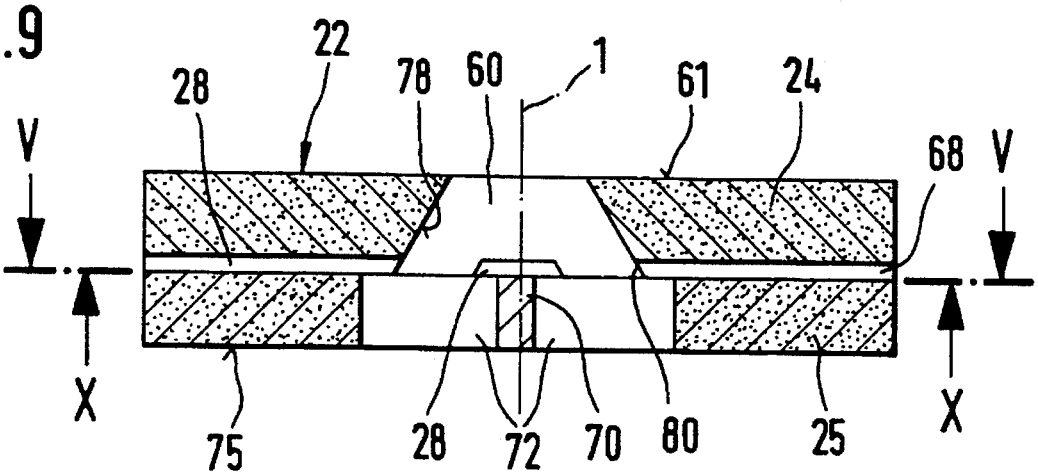
FIG. 9 illustrates a section along the line IX—IX in FIG. 2 in accordance with a fifth exemplary embodiment of the present invention.

Third, fourth and fifth exemplary embodiments of the present invention are shown in FIGS. 7, 8 and 9, respectively. These Figures are sectional views along the lines VII—VII, VIII—VIII, and IX—IX, respectively, in FIG. 2. (The jet splitter 70 depicted in FIG. 2 is shown as having a rectangular cross-section but, is intended to represent of all forms of jet splitters 70, and thus, for instance, also of jet splitters 70 having a hexagonal cross-section.) The same or same-functioning elements are characterized with the same reference numerals as in FIGS. 1 through 6.

These exemplary embodiments differ from the first two exemplary embodiments merely in the design of the jet splitter 70 defined by the through openings 72 or in the length of the conduits 28 in the upper plate 24.

FIG. 7 depicts a third exemplary embodiment of the present invention which has a different jet splitter 70 than the first two exemplary embodiments or which has a different outer boundary edge of the passthrough openings 72 outside of the jet splitter 70 in the lower plate 25. Specifically, the cross-section of the jet splitter 70 no longer has the shape of a rectangle with side surfaces running parallel to the longitudinal valve axis 1 over the entire thickness of the lower plate 25. Rather the cross-section of the jet splitter can be in the shape of a hexagon or of a rhombus.

A hexagonal shape is achieved for the jet splitter 70 by simultaneously anisotropically etching the silicon of both sides of the lower plate 25. The etching takes place from the upper end face 27 and from the lower side 75 of the lower plate 25. The etching masks are arranged on the lower plate 25 so as to allow the etching solution to attack the lower plate 25 for as long as is needed to etch approximately half of its thickness. Thus, a peripheral indentation 77 is formed in each passthrough opening 72 in more or less half the extension length along the longitudinal valve axis 1, from the jet splitter 70 and the passthrough openings 72.

In each case, the indentations 77 allow the smallest planar cross-section of the passthrough openings 72 to be formed at the middle of the thickness of the lower plate 25, while the planar cross-sections of the passthrough openings 72 on the upper end face 27 and on the lower side 75 of the lower plate 25 are the largest. Thus, the etching operation is stopped precisely when half of the thickness of the lower plate 25 is reached, starting from both etching sides, and the described structure is formed, in each case, with two pyramid-stump-shaped volumes (having two trapezoid shaped cross-sections) per passthrough opening 72.

To achieve continuously even and parallel surfaces of the jet splitter 70 and of the passthrough openings 72 for the structure used in the first exemplary embodiment of the present invention (see FIG. 3), the etching operation is continued until the indentations 77 disappear completely. The gas is likewise supplied via the conduits 28 introduced in the lower end face 26 of the upper plate 24. Either the four conduits 28 as in the first exemplary embodiment of the present invention, or the two conduits 28 as in the second exemplary embodiment of the present invention can be used to supply the gas. The size of the passthrough openings 72 is designed based on the number of conduits 28. For example, the size of the passthrough openings 72 can be designed to be clearly smaller in a configuration with two conduits 28 than in a configuration with four conduits 28.

The fourth exemplary embodiment of the present invention illustrated in FIG. 8 is similar to the third exemplary embodiment of the present invention, but has modified conduits 28. In FIG. 8, the conduits 28 extend from the peripheral edges of the plates 24 and 25 to the injection orifice 60, i.e., they are not separated from the injection orifice 60 by protrusions 73. Since the conduits 28, in turn, are etched in at the lower end face 26 of the upper plate 24, the mixture of fuel and gas is now produced in the area directly upstream from the jet splitter 70. In this embodiment, either two or four conduits 28 can be introduced, for example.

The fifth exemplary embodiment of the present invention illustrated in FIG. 9 represents a combination of the conduits 28 in the upper plate 24, known from the fourth exemplary embodiment of the present invention, which run directly from the periphery of the plates 24 and 25 to the injection orifice 60 (i.e., they are not separated from the injection orifice 60 by protrusions 73), and of the jet splitter 70 of the first exemplary embodiment of the present invention. The jet splitter 70 has a rectangular cross-section (or the outer boundary edges of the passthrough openings 72 in the lower plate 25 are flat).

Figure 10:
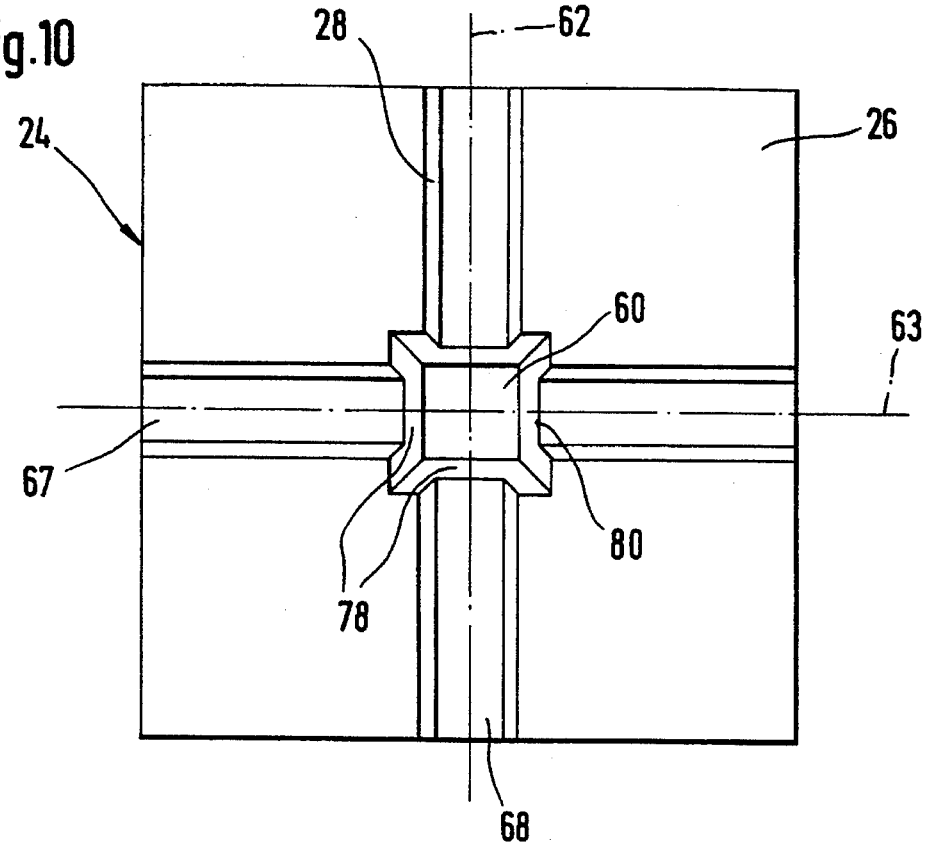
FIG. 10 is a plan view of an upper plate in accordance with the sections along the lines X—X in FIGS. 8 and 9.

FIG. 10 is a plan view of the top plate 24 starting from the lower front end 26, following the cross-sections along the lines X—X in FIGS. 8 and 9. The conduits 28 permit the outer peripheral edges of the plate 24 to be in fluid communication with the injection orifice 60. The pyramid-stump-shaped injection orifice 60 (having trapezoid shaped cross-sections) widens from the upper side 61 of the upper plate 24 to the lower end face 26 of the upper plate 24. In each case, the pyramid-stump-shaped injection orifice 60 is centrical to the axes of symmetry 62 and 63 at the four side surfaces 78 of the pyramid stump and is encountered in the area of the lower end face 26 by four conduits 28 for supplying gas. Thus, the side surfaces 78 of the pyramid-stump-shaped injection orifice 60 surround three sides of each conduit 28 at the conduit entry 80.

The three sides of the conduits 28 are sheathed by the upper plate 24, from the periphery of the plate 24 up to the conduit entry 80. The upper end face 27 of the lower plate 25 constitutes the fourth lateral boundary edge of the conduits 28. However, this fourth lateral boundary edge only extends from the periphery of the plate 25 up to the passthrough openings 72 and thus, for example, ends before the beginning of the injection orifice 60. The completely surrounded conduits 28 represent the flow-in spaces 68.

Figure 11:
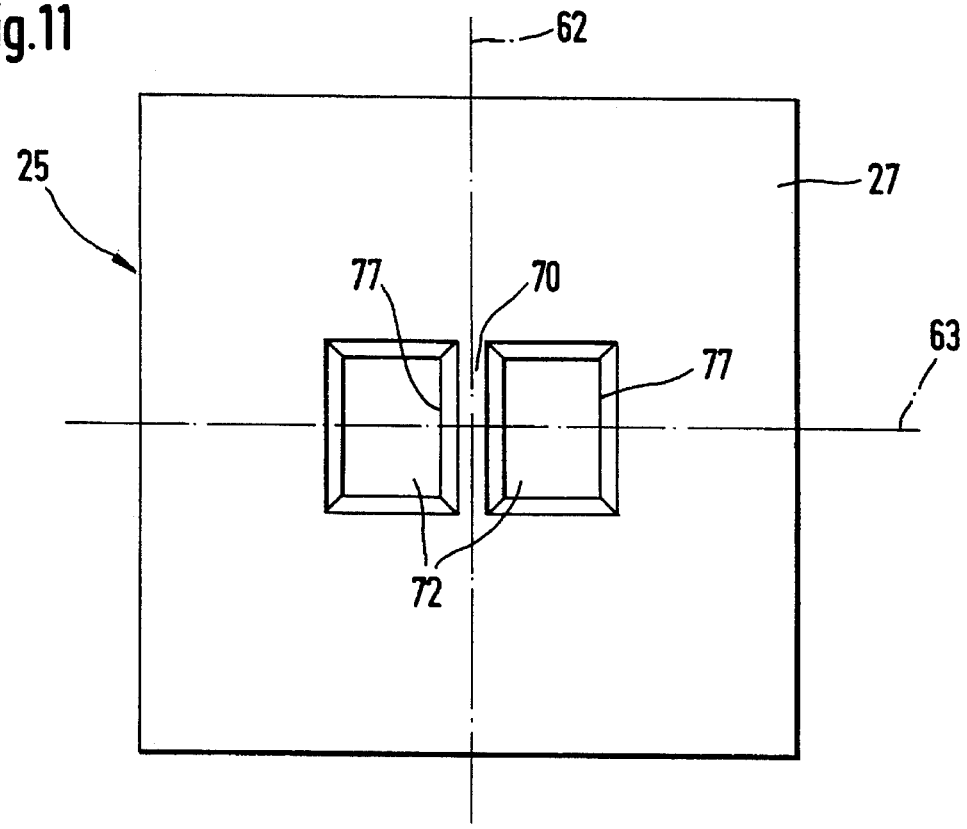
FIG. 11 is a plan view of a lower plate in accordance with the sections along the lines XI—XI in FIGS. 7 and 8.

FIG. 11 is a plan view of the lower plate 25 corresponding to the cross-sections along the lines XI—XI in FIGS. 7 and 8. The passthrough openings 72 are characterized by the peripheral indentations 77, which reduce the cross-sections of the passthrough openings 72. More or less in the area of half of its axial extent, the jet splitter 70, with its hexagonal cross-section, also has these peripheral indentations 77, which are achieved by the two-sided etching. The size of the passthrough openings 72 is designed based on whether two or four conduits 28 are used in the upper plate 24.

In the case of all previously described exemplary embodiments, various factors and properties of the valve nozzle can be influenced through geometric changes. Thus, for example, the size of the jet splitter 70 determines, in each case, the resultant jet angle of the fuel to be spray-discharged. By varying the width of the conduits 28, the dimensions perpendicular to the extension directions of the axes of symmetry 62 and 63 and, thus, the cross-section of the conduits 28 are decisively influenced. The geometry of the gas-surrounded fuel jets can be altered thereby, for example, to obtain flat jets.

Figure 12:
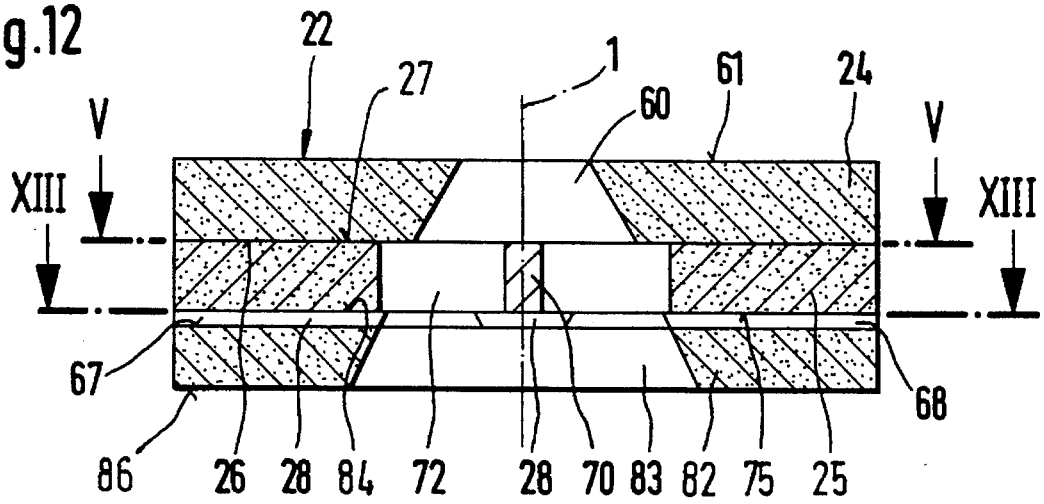
FIG. 12 illustrates a section along the line XII—XII in FIG. 2 according to a sixth exemplary embodiment of the present invention.
Figure 13:
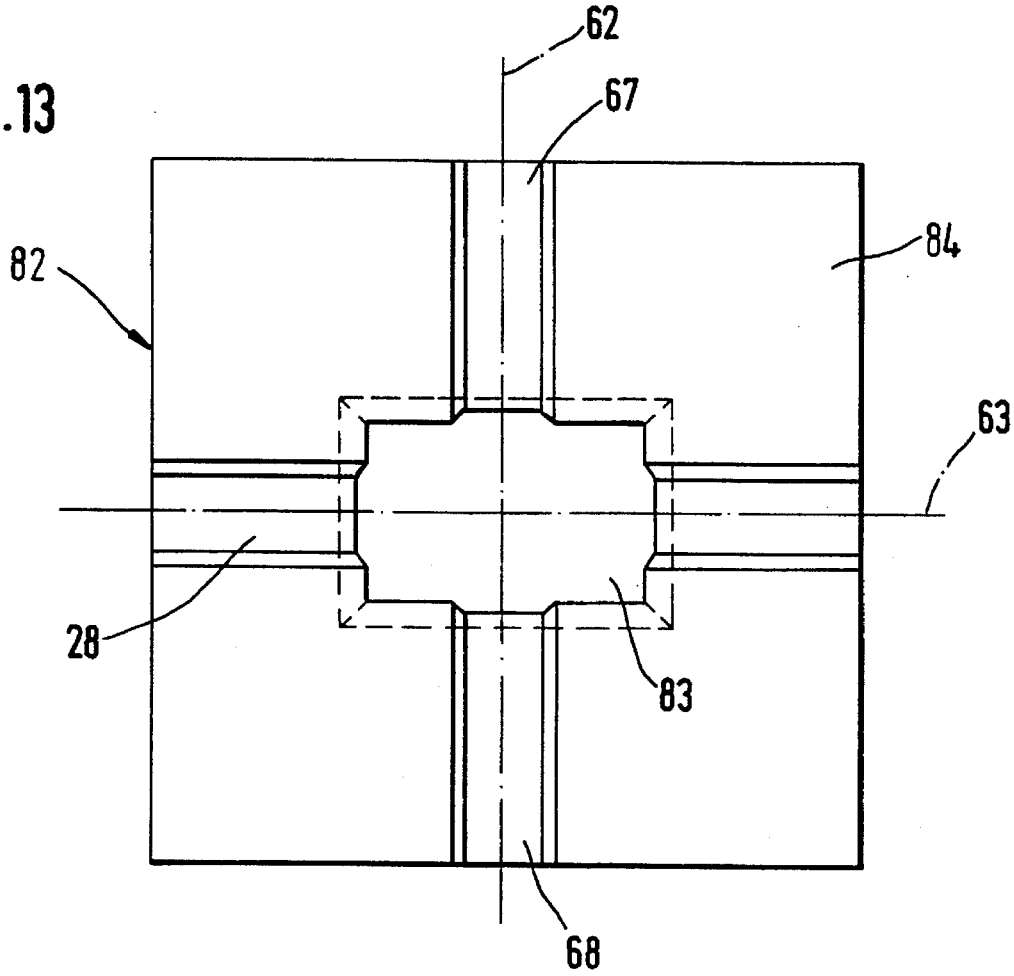
FIG. 13 is a plan view of an additional plate corresponding to a section along the line XIII—XIII in FIG. 12.

In FIG. 12, which is a view of an additional plate 82, and in FIG. 13, which is a plan view of additional plate 82 in accordance with a cross-section along the line XIII—XIII in FIG. 12, an orifice element 22 is shown in accordance with a sixth exemplary embodiment of the present invention. The same and same-functioning parts are characterized with the same reference symbols as in FIGS. 1 through 11. As was the case for the first five exemplary embodiments of the present invention, in the sixth exemplary embodiment, the upper square plate 24 and the lower square plate 25 are made of monocrystalline silicon, for example.

The injection orifice 60, the conduits 28, and the passthrough openings 72 are formed, for example, by anisotropic etching. The orifice element 22 includes three plates, namely the upper plate 24, the lower plate 25, and the additional plate 82 arranged downstream from the lower plate 25. The additional plate 82 also has a square shape, for example, with the same outer dimensions as the plates 24 and 25 of monocrystalline silicon. The three plates 24, 25 and 82 are bonded together.

Disposed concentrically to the longitudinal valve axis 1, an outlet orifice 83, which starts from the upper end face 84 of the additional plate 82 and widens in a pyramid-stump shape (having trapezoidal shaped cross-sections) in the direction of flow, is formed in the additional plate 82. Square passthrough openings 72, spatially separated from one another by the jet splitter 70 and formed in the lower plate 25 symmetrically to the longitudinal valve axis 1, are in fluid communication with the outlet orifice 83.

The two passthrough openings 72 of the lower plate 25 are situated downstream from the injection orifice 60 of the upper plate 24, thereby allowing the fuel to enter easily into the passthrough openings 72 since the outer boundary edge of the passthrough openings 72 has a larger dimension than the injection orifice 60 at the lower end face 26 of the upper square plate 24. The injection orifice 60 widens in a pyramid-stump shape (having trapezoid shaped cross-sections), starting from the top side 61 of the upper plate 24 in the direction of its lower end face 26.

The three plates 24, 25 and 82 are delimited to the outside by side surfaces, which, at their ends, are at right angles to one another. Starting from each of the side surfaces, one conduit 28, which has a rectangular trench bottom 67 and extends inwardly, directly up to the outlet orifice 83, is configured at the upper end face 84 of the additional plate 82. The conduits 28 are disposed symmetrical to the axes of symmetry 62 (or 63). The conduits 28 are tapered in a trapezoidal shape in the direction of the lower side 86 of the additional plate 82. Together with the lower side 75 of the lower plate 25, the conduits 28 form an inflow-space 68, in each case.

The conduits 28 for supplying gas are thus formed in the additional plate 82, while the fuel for producing or maintaining a dual-jet characteristic is divided upstream in the lower plate 25 by the jet splitter 70. After the jet of fuel is divided the jet splitter 70, the fuel emerging out of the passthrough openings 72 first meets with the gas discharged substantially perpendicular to it. The narrow cross-section of the conduits 28 causes the gas to be accelerated, so that the gas encounters the spray-discharged fuel at a high speed and surrounds this fuel while forming very fine droplets. Thus, a substantially homogeneous fuel-gas mixture is produced.

This sixth exemplary embodiment of the present invention can be realized in different variations, which result from further providing the additional plate 82 to the five exemplary embodiments of the present invention already described. The geometry of the jet splitter 70 in the lower plate 25 can conceivably be altered by using the jet splitter 70 with the hexagonal cross-section, for example (not shown). Moreover, the number of conduits 28 is variable. Thus, besides the exemplary embodiment shown in FIG. 13 with four conduits 28, in accordance with the second exemplary embodiment, etching out only two conduits 28 is also possible. When only the division of the jet is supposed to be effective, the surrounding gas is not needed. Changing the proportions of the widths of the conduits 28 perpendicularly to the axes of symmetry 62 and 63 effects, in turn, a geometric deformation of the fuel jets.

Figure 14:
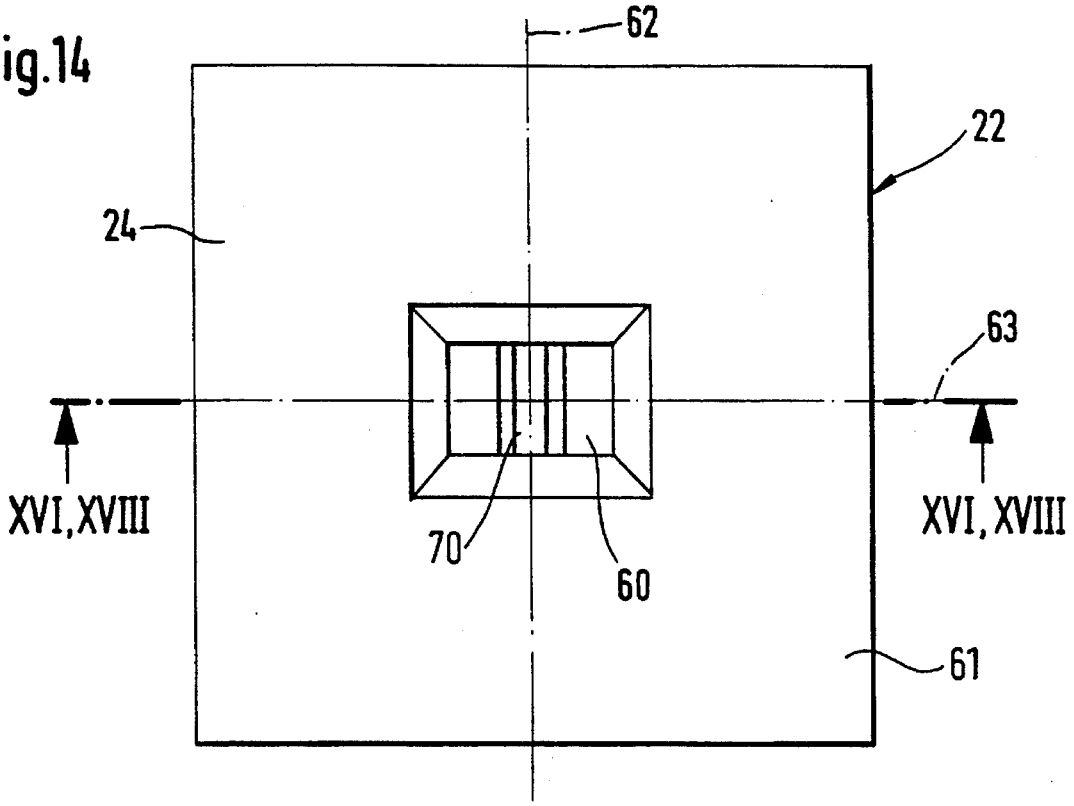
FIG. 14 is a top view of an upper plate of an orifice element in accordance with a seventh exemplary embodiment of the present invention. A jet splitter of a lower plate is also shown.

An orifice element 22 in accordance with a seventh exemplary embodiment of the present invention is shown in FIG. 14 as a top view of the upper plate 24. The same and same-functioning elements are characterized with the same reference symbols as in FIGS. 1 through 13. In contrast to the six previous exemplary embodiments of the present invention, the upper plate 24 of the seventh exemplary embodiment has a pyramid-stump-shaped injection orifice 60 (having trapezoid shaped cross-sections) which is disposed symmetrically to the longitudinal valve axis 1 and which is tapered (i.e., narrows), starting from the upper side 61 of the upper plate 24 toward the lower end face 26 of the upper plate 24. Thus, the fuel jet at the lower end face 26 of the upper plate 24 becomes smaller in cross-section and is therefore accelerated. As a result, the fuel impacts the jet splitter 70 situated in the lower plate 25 at a higher speed.

Figure 15:
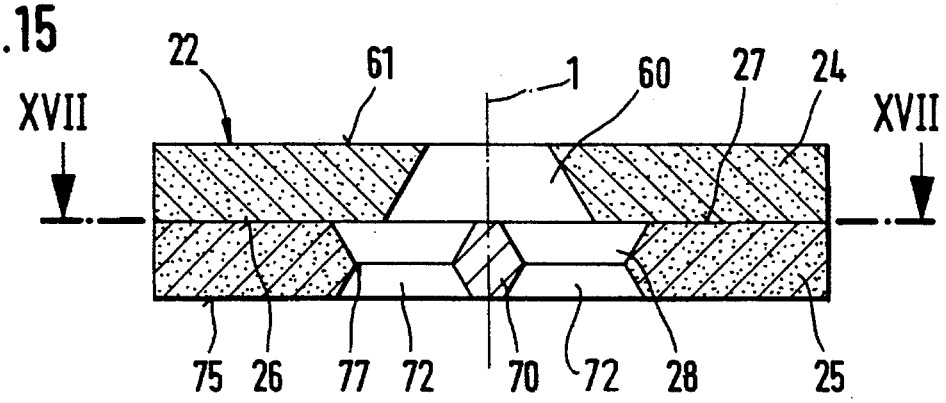
FIG. 15 illustrates a section along the line XV—XV in FIG. 2 according to an eighth exemplary embodiment of the present invention.

An eighth exemplary embodiment of the orifice element 22 of the present invention is depicted in FIG. 15 in accordance with a cross-section along the line XV—XV in FIG. 2. The square upper plate 24 has a pyramid-stump-shaped injection orifice 60 (having trapezoid shaped cross-sections) which is disposed symmetrically to the longitudinal valve axis 1 and which widens starting from the upper side 61 of the upper plate 24 toward the lower end face 26 of the upper plate 24. The flowthrough section 20 of the flow conduit 5 of the injection valve has a cross-section that overlaps the injection orifice 60 and is coupled, in fluid communication, upstream from the injection orifice 60.

Figure 16:
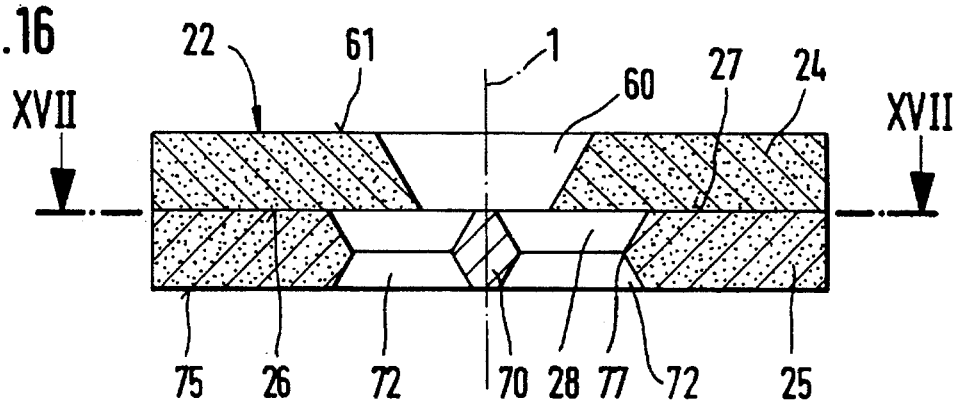
FIG. 16 illustrates a section along the line XVI—XVI in FIG. 14 according to a ninth exemplary embodiment of the present invention.

A ninth exemplary embodiment of the orifice element 22 of the present invention is shown in FIG. 16. The ninth exemplary embodiment differs from the exemplary embodiment depicted in FIG. 15 only in that the pyramid-stump-shaped injection orifice 60 (having trapezoid shaped cross-sections) in the upper plate 24 is tapered (i.e., narrows) starting from the top side 61 of the upper plate toward the lower end face 26 of the upper plate 24. FIG. 16 is a cross-sectional representation, which results from a section along the line XVI—XVI in FIG. 14.

Figure 17:
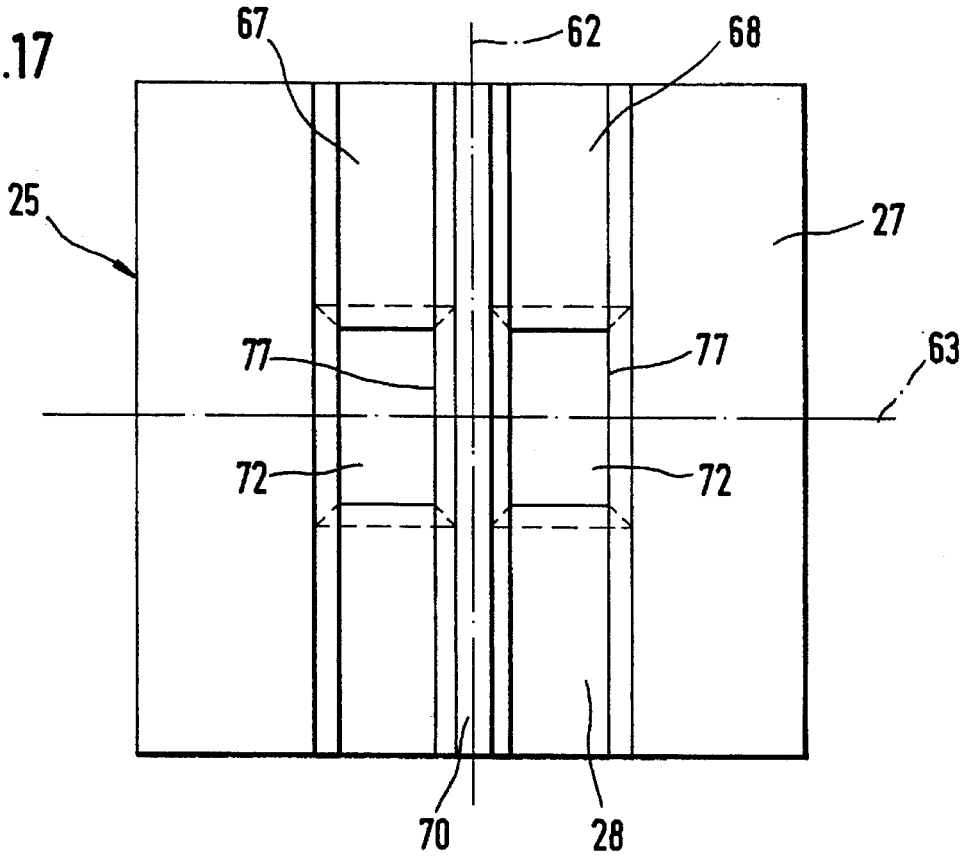
FIG. 17 is a plan view of a lower plate corresponding to the sections along the lines XVII—XVII in FIGS. 15 and 16.

In the orifice elements 22 of the eighth and ninth exemplary embodiments, the lower plate 25 has an identical design. FIG. 17 shows a sectional representation, which results from intersections along the line XVII—XVII in FIGS. 15 and 16, and thus applies both for the eighth and the ninth exemplary embodiment. In each case, the plane of intersection is the joining surface of the upper plate 24 and the lower plate 25.

The outer contour of the lower plate 25 is likewise square in shape. The orifice element 22 has axes of symmetry 62 and 63, which each halve the outer side surfaces of the two plates 24 and 25. A jet splitter 70 has a upstream to downstream thickness which equals the upstream to downstream thickness of the lower plate 25 and has a hexagonal cross-section. The jet splitter 70 extends along the axis of symmetry 62 over the entire plate 25, from an outer side surface up to the diametrically opposing outer side surface. The jet splitter 70 is formed only in the area of the passthrough openings 72 across the entire thickness of the lower plate 25, while extending outside of the passthrough openings 72, only up to approximately half the upstream to downstream thickness of the lower plate 25. In this embodiment, the jet splitter 70 not only splits the fuel jet into two passthrough openings 72, but it also ensures that the gas is separated into two conduits 28, each running parallel to the axis of symmetry 62 and to the jet splitter 70.

The jet splitter 70 is formed in the area of the passthrough openings 72 by simultaneously anisotropically etching both sides of the silicon of the lower plate 25. The etching is carried out from the upper end face 27 of the lower plate 25 and from the lower side 75 of the lower plate 25. The etching masks are arranged on the lower plate 25 to allow the etching solution to attack for as long as is necessary to etch approximately half of the thickness of the lower plate 25. However, the etching masks are designed so as to allow two-sided etching only in the area of the passthrough openings 72 to be formed. In areas outside of the passthrough openings 72, parallel to the axis of symmetry 62, the etching is only carried out on one side, starting from the top end face 27 of the lower plate 25, up to roughly half of the thickness of the lower plate 25. As a result, the conduits 28 used for supplying the gas are produced.

In this manner, the planar smallest planar cross-section of the passthrough openings 72 is formed at about half the extension length, along the longitudinal valve axis 1 of the jet splitter 70 and the passthrough openings 72, by a peripheral indentations 77 in each passthrough opening 72. The planar cross-section of the passthrough openings 72 at the upper end face 27 and at the lower side 75 of the lower plate 25 is the largest. The etching operation is halted when half of the thickness of the lower plate 25 is reached, starting from both etching sides.

The four conduits 28, used for supplying the gas to the fuel flowing through the passthrough openings 72, extend continuously through the plate, from one side to another, and run parallel to one another. The two conduits 28 are only interrupted by the upper pyramid-stump-shaped section of the passthrough opening 72 directed toward the upper plate 24. Together with the lower end face 26 of the upper plate 24, the conduits 28 form inflow spaces 68. The conduits 28 are tapered (i.e., narrow) in a trapezoidal shape, in accordance with the etching operation, in the direction of the lower side 75 of the lower plate 25 up to approximately half of the thickness of the plate 25 and run symmetrically to the axis of symmetry 62, from one outer side surface of the lower plate 25 to the diametrically opposing side surface of the lower plate 25.

The refinement of the lower plate 25 in accordance with the eighth and ninth exemplary embodiment of the present invention can be manufactured very inexpensively because of its simple structure, and is therefore especially advantageous. In one single etching operation, namely, both the conduits 28 and the jet splitter 70 (or the passthrough openings 72) can be formed in one plate 25. The width of the jet splitter 70 (or of the conduits 28) can be varied to adjust various jet angles, in turn, for the fuel.

Figure 18:
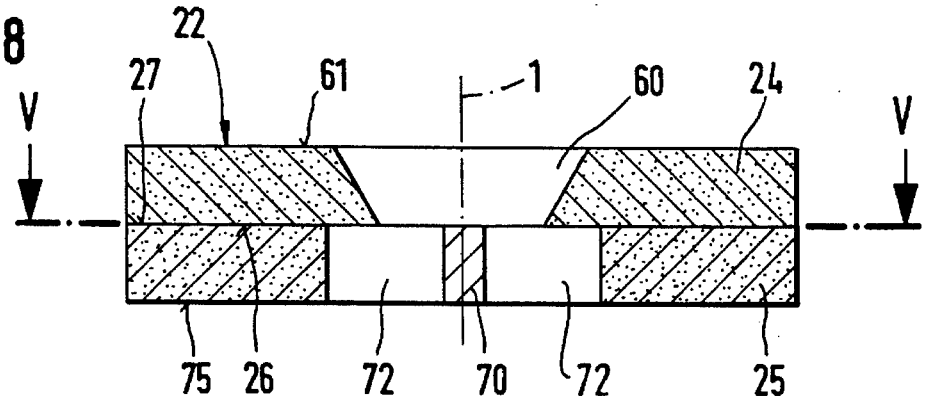
FIG. 18 illustrates a section along the line XVIII—XVIII in FIG. 14 in accordance with a tenth exemplary embodiment of the present invention.
Figure 19:
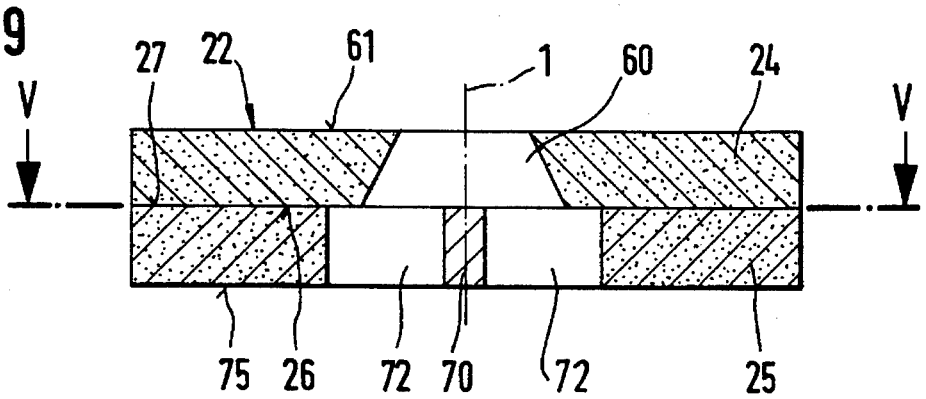
FIG. 19 illustrates a section along the line XIX—XIX in FIG. 2 in accordance with an eleventh exemplary embodiment of the present invention.

FIGS. 18 and 19 depict further exemplary embodiments of the present invention. These embodiments do not use a surrounding gas, but can otherwise be viewed as combinations of the already known structures in the upper and lower plates 24 and 25. FIG. 18 depicts a section along the line XVIII—XVIII in FIG. 14, and FIG. 19 depicts a section along the line XIX—XIX in FIG. 2. The two plates 24 and 25 are bonded together.

In both exemplary embodiments, which differ from one another only by the pyramid-stump-shaped injection orifice 60 in the upper plate 24, there are no conduits for supplying gas. In the exemplary embodiment according to FIG. 18, the injection orifice 60 is tapered (i.e., narrows) in the described manner from the upper side 61 toward the lower end face 26, while in the exemplary embodiment according to FIG. 19, the injection orifice 60 is widened, starting from the top side 61 toward the bottom end face 26. The jet splitter 70 in the lower plate 25 ensures that the fuel emerging from the injection orifice 60 is divided between the two passthrough openings 72. In this way, a dual-jet characteristic of the valve is produced or is retained. The jet angle of the fuel can be influenced by changing the geometry of the jet splitter 70.

The orifice element 22 can not only be used in fuel-injection valves for fuel-injection systems, but also for atomizing other media in applications requiring very fine liquid droplets, such as the uniform spraying of dyes and lacquers, and in manufacturing processes, or the like.

What is claimed is:

1. An orifice element for injecting a medium, the orifice element comprising:

a) an upper plate, the upper plate having at least one injection orifice;

b) a lower plate, the lower plate i) being arranged downstream from the upper plate, ii) having a passthrough opening and a jet splitter which divides the passthrough opening into at least two passthrough openings, and iii) having an upper end face;

wherein the at least one injection orifice of the upper plate is arranged such that the at least one injection orifice at least partially overlaps the at least two passthrough openings and the jet splitter, and in the upper end face of the lower plate a cross-section of the jet splitter is smaller than each cross-section of the at least two passthrough openings.

2. The orifice element according to claim 1 wherein the upper plate and the lower plate are made of monocrystalline silicon.

3. The orifice element according to claim 2 wherein the lower plate is etched simultaneously from two sides.

4. The orifice element according to claim 1 wherein the lower plate has a first thickness and the jet splitter has the first thickness.

5. The orifice element according to claim 4 wherein the at least two passthrough openings have inner boundary edges which define side walls of the jet splitter, and outer boundary edges, the inner boundary edges and the outer boundary edges being parallel to one another over the first thickness of the lower plate whereby the jet splitter has a rectangular cross-section.

6. The orifice element according to claim 4 wherein the at least two passthrough openings each have a side cross-section defined by two pyramid-stump-shaped sections, and wherein a smallest plan cross-section of each of the at least two passthrough openings lies approximately at half of the first thickness of the lower plate and is delimited by projections.

7. The orifice element according to claim 6 wherein the jet splitter has a rhombus-shaped cross-section.

8. The orifice element according to claim 6 wherein the jet splitter has a hexagonal cross-section.

9. The orifice element according to claim 6 wherein an upper face of the lower plate defines conduits for supplying a gas, the upper face of the lower plate facing the upper plate, the conduits, in each case, extending from a peripheral edge of the lower plate, parallel to the jet splitter, to an area of half of the first thickness of the lower plate at a height of the projections.

10. The orifice element according to claim 9 wherein two diametrically opposing conduits extend, in alignment, into each of the at least two passthrough openings.

11. The orifice element according to claim 1 wherein at least two conduits are defined on a lower end face of the upper plate, the lower end face facing the lower plate, the at least two conduits beginning at a peripheral edge of the upper plate and extending inward towards the injection orifice of the upper plate, and wherein the at least two conduits and an upper end face of the lower plate define inflow spaces for a gas.

12. The orifice element according to claim 11 wherein the upper plate further includes webs which spatially separate the at least two conduits from the injection orifice of the upper plate.

13. The orifice element according to claim 11 wherein the at least two conduits extend from the peripheral edges of the upper and lower plates, to the injection orifice of the upper plate.

14. The orifice element according to claim 11 wherein the injection orifice, the at least two passthrough openings, and the at least two conduits are formed by anisotropic etching.

15. An orifice element for injecting a medium, the orifice element comprising:

a) an upper plate, the upper plate having at least one injection orifice;

b) a lower plate, the lower plate i) being arranged downstream from the upper plate, and ii) having a passthrough opening and a jet splitter which divides the passthrough opening into at least two passthrough openings;

c) an additional plate, the additional plate i) being located downstream from the lower plate, and ii) having an outlet orifice, the outlet orifice at least partially overlapping the at least two passthrough openings, wherein the at least one injection orifice of the upper plate is arranged such that the at least one injection orifice at least partially overlaps the at least two passthrough openings and the jet splitter.

16. The orifice element according to claim 15 wherein an upper end face of the additional plate defines at least two conduits, the upper end face of the additional plate facing the lower plate, the at least two conduits beginning at a peripheral edge of the additional plate and extending inward, the at least two conduits and a lower side of the lower plate defining inflow spaces for a gas.

17. The orifice element according to claim 15 wherein side cross-sections of the injection orifice of the upper plate, of the at least two passthrough openings, and of the outlet orifice in the additional plate remain constant.

18. The orifice element according to claim 15 wherein side cross-sections of the injection orifice of the upper plate, of the at least two passthrough openings, and of the outlet orifice in the additional plate widen in a downstream direction.

19. A valve for supplying at least a fuel, the valve comprising:

a) a valve closure part;

b) a valve-seat surface having a shape corresponding to the valve closure part and being located in a downstream direction from the valve closure part;

c) a thin, plate-shaped orifice element arranged downstream from the valve-seat surface, the orifice element comprising i) an upper plate facing the valve-seat surface and having at least one injection orifice, and ii) at least one lower plate further in the downstream direction, the at least one lower plate having at least two passthrough openings and a jet splitter which is formed in the at least one lower plate and which separates the at least two passthrough openings, the at least one lower plate having an upper end face, in the upper end face of the at least one lower plate a cross-section of the jet splitter being smaller than each cross-section of the at least two passthrough openings, wherein the at least one injection orifice of the upper plate at least partially overlaps the at least two passthrough openings and the jet splitter.

* * * * *